United States Patent [19]

Wagenknecht et al.

[11] Patent Number: 4,709,843

[45] Date of Patent: Dec. 1, 1987

[54] SYSTEM FOR SECURING WEDGE SOCKETS

[75] Inventors: Juergen Wagenknecht, Pinneberg; Dieter Raedisch, Hamburg, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 827,356

[22] Filed: Feb. 7, 1986

[30] Foreign Application Priority Data

Feb. 9, 1985 [DE] Fed. Rep. of Germany ..... 3504437

[51] Int. Cl.[4] ..... B25B 31/00; B25C 1/04; B25C 1/06

[52] U.S. Cl. ..... 227/156; 29/243.53; 227/52

[58] Field of Search ..... 227/156, 146, 147, 52; 29/243.53, 243.54; 411/500, 75, 79, 39, 40, 41

[56] References Cited

U.S. PATENT DOCUMENTS

| | | | |
|---|---|---|---|
| 3,724,738 | 4/1973 | Hurst | 227/147 |
| 3,974,621 | 8/1976 | Stang | 411/75 |
| 4,479,601 | 10/1984 | Hara | 227/147 |
| 4,517,820 | 5/1985 | Oefinger et al. | 29/243.53 |

FOREIGN PATENT DOCUMENTS 2660234 8/1979 Fed. Rep. of Germany .

*Primary Examiner*—Paul A. Bell
*Assistant Examiner*—Hien H. Phan
*Attorney, Agent, or Firm*—W. G. Fasse; D. H. Kane, Jr.

[57] ABSTRACT

A system for setting or driving wedge sockets into holes of a structural component combines a mounting member having two shaft sections forming the socket, with a driver having a pistol shape with a pistol grip and a trigger for releasing an automatic impact force. The driver, for example energized by compressed air or by a cocked spring, applies a predetermined impact energy to one of the two shaft sections. The apparatus enables an operator to work efficiently, especially where large numbers of such fasteners must be set.

9 Claims, 7 Drawing Figures

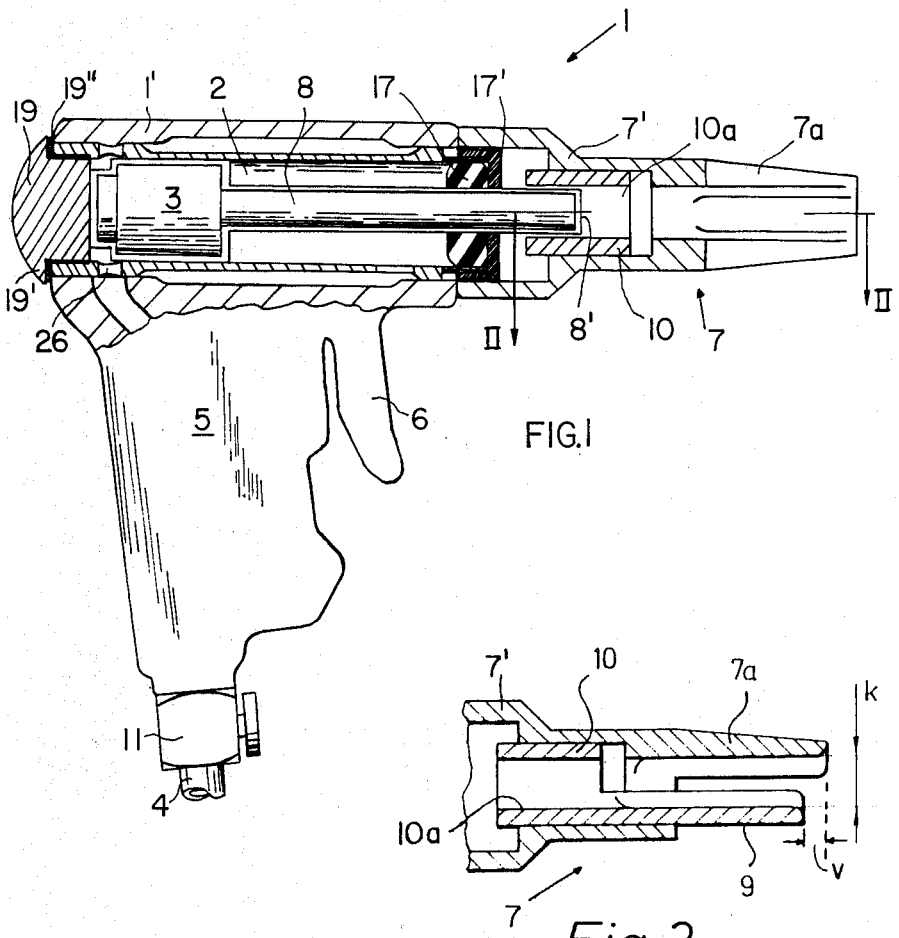
FIG. 1
Fig. 2
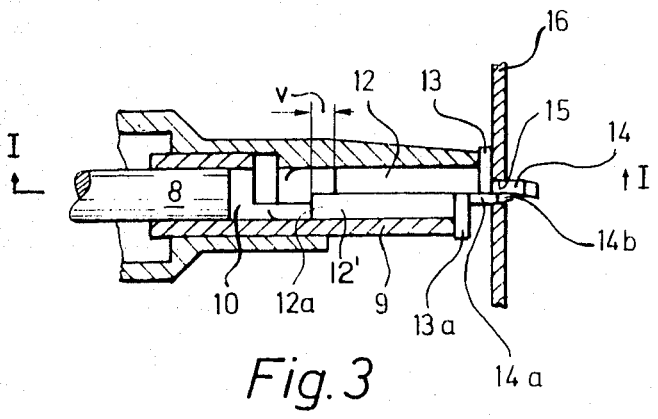
Fig. 3

SYSTEM FOR SECURING WEDGE SOCKETS

FIELD OF THE INVENTION

The invention relates to a system for securing wedge sockets. Such a wedge socket is part of a mounting member used for securing or mounting electrical conductors to other structural components such as aircraft structural components. These sockets are inserted into holes of the structural components with a wedging fit.

DESCRIPTION OF THE PRIOR ART

German Patent (DE-PS) No. 2,660,234 discloses a mounting member with a wedge socket for securing electrical conductors preferably to aircraft structural components. Such wedge sockets are insertable exclusively into holes from the front or facing side of a plate type structural component. For this purpose the wedge sockets have a shaft which is longitudinally divided into at least two sections which are slidable relative to each other in the longitudinal or axial direction of the shaft for anchoring the wedge socket in the hole. One shaft section is first inserted into the hole or bore and this one shaft section widens behind the bore when a second shaft section of prismatic cross-section is subsequently inserted into the bore by sliding longitudinally along the first inserted shaft section. Both shaft sections participate in the formation of the shaft diameter or shaft circumference which cooperates with the hole diameter. This prior art wedge socket is so constructed that the wedge portion which widens radially behind the bore is bent outwardly. The widening portion or portions begin already inside the bore and extend into positions outside of the bore behind the wall of the structural component through which the hole extends. The shaft sections are interconnected by a tightenable hose clamp or belt. The sockets are driven or set into their predrilled holes by a pressure force extending axially of the socket shaft and toward the structural component. The driving or setting of the socket is accomplished by a tubular tool comprising a sleeve closed at one end by a hand plate while the other end is open for receiving and holding a wedge socket. This type of tool makes it possible to set or drive the sockets by first inserting that shaft section that needs to be inserted before the other shaft section and then manually applying a driving force to the hand plate for pressing the other shaft section into the hole.

The tool according to German Patent (DE-PS) No. 2,660,234 has the following disadvantages. The operator must exert the inserting pressure manually, whereby the operation is very tiring, especially where a large number of such wedge sockets must be set or inserted. As a result, frequently the operator resorts to using a hammer. Using a hammer easily results in an impact which is either too high or too low so that either the structural component may be damaged or that several blows are necessary to properly set the wedge socket. Further, it may be necessary to provide some countermass which can be held only by a second person.

OBJECTS OF THE INVENTION

In view of the foregoing it is the aim of the invention to achieve the following objects singly or in combination:

- to set or drive the wedge sockets by a mechanical impact as compared to a manually effected hammer blow;
- to make sure that the setting energy or the energy of the setting impact is always constant under the same conditions so that all sockets of the same type are uniformly set;
- to provide for an adjustment of the required impact energy so that such impact energy may be adjusted for the type of structural component involved and also for the type and size of socket used; and
- to construct the setting tool in such a way that it can be operated with one hand enabling the operator to himself hold a counter-mass if that should become necessary.

SUMMARY OF THE INVENTION

The tool for setting or driving wedge sockets into predrilled holes is constructed according to the invention to have a pistol shape with a handle and a trigger, whereby inside the housing having the pistol shape a driver is arranged for transmitting a driving force to the wedge socket in response to the operation of the trigger. This apparatus according to the invention has the advantage that the driving force applied to the respective shaft section is always applied only by a single impact. The structural components cannot be damaged because the impact energy is precisely controlled. The operator can, if necessary, hold a counter-mass.

BRIEF DESCRIPTION OF THE DRAWINGS

In order that the invention may be clearly understood, it will now be described, by way of example, with reference to the accompanying drawings, wherein:

FIG. 1 is a side view, partially in section along section line I—I in FIG. 3, but without a wedge socket, showing a pneumatically operating driving hammer for setting wedge sockets;

FIG. 2 is a sectional view along section line II—II in FIG. 1, showing one type of nozzle end forming a wedge holder for holding and driving a wedge socket;

FIG. 3 is a view similar to that of FIG. 2, but showing a wedge socket inserted into the wedge holder;

DETAILED DESCRIPTION OF PREFERRED EXAMPLE EMBODIMENTS AND OF THE BEST MODE OF THE INVENTION

Figure 4:
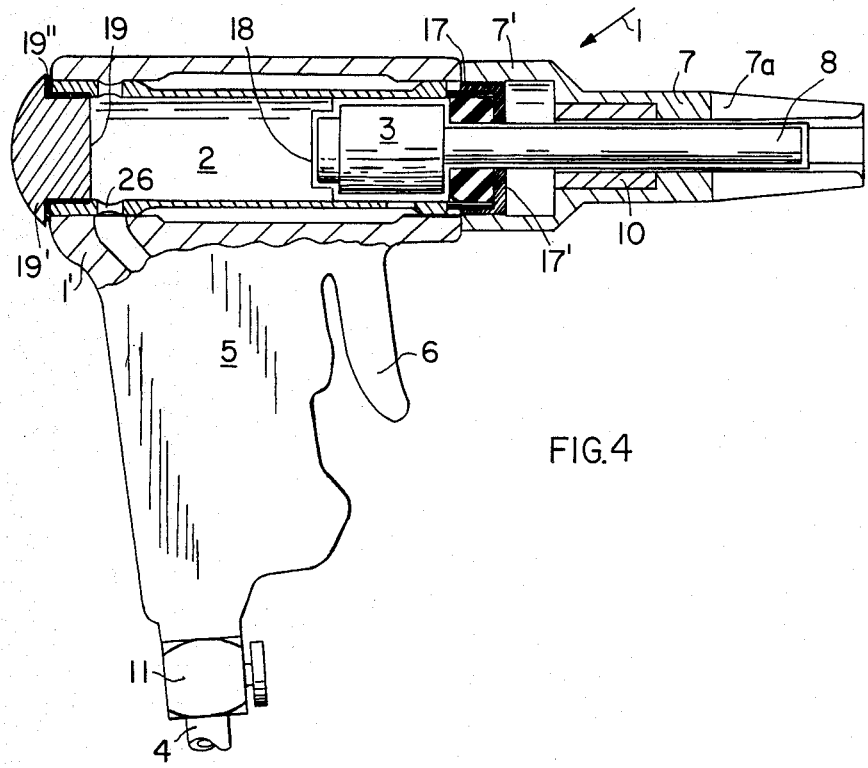
FIG. 4 is a view similar to that of FIG. 1, but showing a driver in the position at the end of a driving stroke and including a different type of wedge holder nozzle end.

FIGS. 1 and 4 show a driving hammer 1 having a housing 1' with a pistol type configuration including a grip 5 to which a pressure hose 4 is connected through an adjustable valve 11. The valve 11 is used for adjusting the pressure applied to the driver piston 3 slidable back and forth in a cylinder 2 for driving a driver piston rod 8 having an end surface 8' for impacting on an end portion **12*a* of a wedge socket 12, 12' shown in FIG. 3. The barrel and nozzle end 7 of the pistol type housing forms a wedge holder 7*a* and has a guide bushing 10 preferably of hardened metal, with a guide bore 10*a* for the piston rod 8. The guide bore 10***a* has a diameter corresponding about to k shown in FIG. 2 permitting a guided slide fit of the driver piston rod 8 in the bore 10*a*. The trigger 6 controls a conventional valving mechanism, not shown, for driving the piston 3 with its rod 8 in a single stroke motion for each actuation of the trigger 6. Such valving mechanisms are well known in connection with riveting hammers or the like.

The free end of the nozzle end 7 of the housing 1' forms the mentioned wedge holder 7*a* for holding a wedge socket 12, 12*a* shown in FIG. 3. As best seen in FIG. 2, the sleeve 10 forms a unit with a holder member 9 which cooperates with the holder 7*a* for properly holding a wedge socket when the latter has its individual sections 12, 12' still displaced relative to each other in the direction of the longitudinal socket axis as is shown in FIG. 3 and will be described in more detail below. The holder members 7*a* and 9 enclose a hollow space having preferably a square cross-section whereby the side length of the square corresponds to k. The left-hand portion of the socket holder member 9 forms the above mentioned guide sleeve 10 for the driver 8, whereby the diameter of the guide bore 10*a* corresponds approximately to k. The bushing 10 and the member 9 are slidable together in the axial direction. The piston 3 and the driver 8 are made of a suitable material having a relatively low density such as polyamide in order to limit the impact energy to an upper limit taking into account the available supply pressures.

FIG. 3 shows the holder portion of the apparatus 1 with a wedging socket having first and second shaft sections 12, 12' inserted into an open end recess of the holder. The wedge socket or shaft sections 12 and 12' are slidable relative to each other in the longitudinal direction. Each shaft section has a flange portion 13 and 13*a* and a shaft wedging portion 14 and 14*a* forming together a wedging socket. The second shaft section 12' has a head portion 12*a* on which the end wall 8' of the piston rod 8 impacts. In the starting position the shaft wedging portion 14 of the first shaft section is first fully inserted into the hole 15 in a structural component such as a sheet metal wall 16, whereby the flange portion 13 comes to rest on the outwardly facing surface of the sheet metal wall 16. The second shaft section 12' is axially shifted by a defined axial distance v as shown in FIG. 3. This axial distance v is so selected that the shaft wedging portion 14*a* with its slanted part 14*b* reaches only partially into the hole 15 in the starting position. If now the trigger 6 is pulled, the driver piston rod 8 hits the left-hand end portion 12*a* of the second shaft section 12', thereby driving that shaft section axially to an extent sufficient to fully force the shaft portion 14*a* having a prismatic cross-section into the hole 15 until the flange portion 13*a* also contacts the surface of the sheet metal wall 16. The two shaft portions 14 and 14*a* in the hole 15 have lower end sections widening toward each other so that when these end sections contact each other, the shaft portions 14 and 14*a* actually are wedged apart, thereby firmly setting the socket in the hole 15. During the driving operation the socket holder member 9 slides axially together with the socket shaft portion 12' toward the bore 15 so that the shaft portion 12' is properly guided and held against lateral displacement during the driving motion. The defined axial distance v makes sure that the first shaft section 12 limits the axial movement of the second shaft section 12', as best seen in FIG. 3.

FIG. 4 shows an apparatus similar to that of FIG. 1, whereby the piston 3 with the driver 8 is illustrated in its right-hand end position at the completion of a driving stroke. A bumper body 17 of elastically yielding material is located at the right-hand end of the cylinder 2. The bumper body 17 is so dimensioned that it deflects the piston 3 back to the left-hand end position as shown in FIG. 1. The bumper body 17 is further so positioned and dimensioned that a sufficient impact energy is applied to a wedge socket. Any excess energy is taken up by the bumper body 17. Two magnet elements 18 and 19 are located at the left-hand end of the piston 3 and at the left-hand end of the housing 1'. The magnetic poles of the elements 18 and 19 are so located that they attract each other for normally keeping the piston 3 in the left-hand end position. At least one of the elements 18 or 19 is a permanent magnet. Thus, when the elastic forces of the bumper body 17 have reflected the cylinder 3 back into the left position, the cooperation of the magnet elements 18 and 19 makes sure that the piston 3 is kept in the left-hand end position until pneumatic pressure is applied again through the hole 26 in the cylinder 2. On the return stroke of the piston 3 the cylinder space is properly vented as is conventional.

The nozzle end 7 has a body 7', the left-hand end of which has an internal threading cooperating with an external threading of an intermediate bushing 17' which also has an internal threading cooperating with an external threading on the right-hand end of the cylinder 2. The magnetic member 19 has an external threading cooperating with an internal threading at the left end of the cylinder 2. The member 19 has a flange 19' bearing against the left end of the cylinder 2 and against the left end of the housing 1', preferably through a seal 19''. The left end of the nozzle body 7' bears against the right-hand end of the housing 1' when elements 19 and 7' are tightened. The bumper body 17 is held in place in the right-hand end of the cylinder 2 by the bushing 17' which itself is held in place on the external threading of the cylinder 2.

Figure 5:
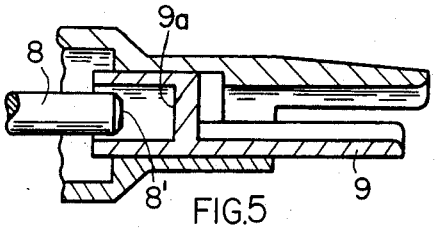
FIG. 5 is a sectional view similar to FIG. 3, and showing a further modification of a wedge holder nozzle end.

FIG. 5 shows an embodiment of the invention, wherein the driver piston rod 8 and the holding element 9 are so constructed that the driver 8 does not impact directly onto the wedge sockets, but rather impacts on a cross wall 9*a* of the holding element 9. For this purpose the cross wall 9*a* of the holding element 9 faces directly the impact end 8' of the piston rod 8 which impacts on the cross wall and the right-hand end of the holding element 9 impacts on the flange portion 13*a* of the socket.

Figure 6:
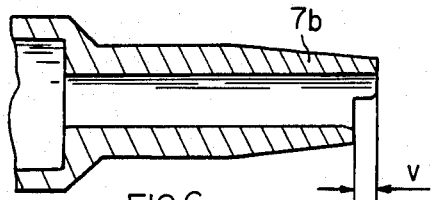
FIG. 6 is a sectional view through another embodiment of a wedge holder nozzle.

FIG. 6 shows another embodiment of a suitable holding nozzle 7*b* for wedge sockets not requiring a continuous lateral support for preventing a lateral yielding before a portion or section of the socket has completely entered into the hole. The holding nozzle 7*b* forms a single-piece, integral element. The shape is basically the same as shown in FIGS. 2, 3, and 5 for providing the spacing v in the axial direction. When the wedge socket or at least its half portion 12*a* is strong enough, there is no danger of any lateral yielding in the spacing v while the driver piston rod 8 applies an impact directly to a wedge socket for wedging the socket into the hole 15.

In the embodiments so far described, the size of the impact energy may be adjusted with the aid of the valve 11 as mentioned above.

Figure 7:
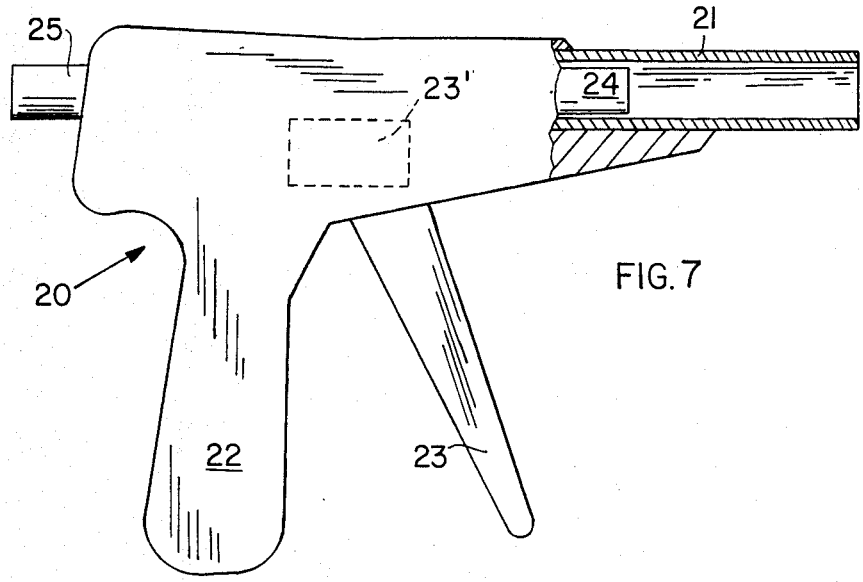
FIG. 7 is a view of a modified embodiment also partially in section, which is driven by a cockable spring.

FIG. 7 illustrates an embodiment in which the housing 20 again has a pistol configuration with a grip 22 and a trigger 23. The holder for the sockets forms a tubular member 21 which is also a guide for the driver 24 driven by a spring mechanism 23' shown in block form since such mechanisms are known. The driving of the driver rod 24 by the spring mechanism 23' takes place in response to the operation of the trigger 23 which simultaneously serves for cocking the spring and for releasing or triggering an impact. Such mechanisms 23' are quite similar to those known, for example in connection with construction staplers used for securing batts of fiberglass. The spring of the mechanism 23 may be guided in the tubular member 21 and its energy is applied to the inner end of the driver 24. The driver 24 may comprise a rod of thinner diameter which forms an inner guide for the spring and which is slidably received in a central longitudinal bore of an adjustment knob 25. The adjustment knob 25 has an outer threading inside the housing 20 and such outer threading cooperates with an inner threading of a stationary bushing inside the housing for biasing the spring by rotating the knob 25.

The operation is basically the same as described above, except that prior to each first stroke, the spring needs to be cocked with the aid of the trigger lever 23. The spring release takes place when the trigger 23 reaches a predetermined position, whereby a socket held in place inside the tubular member 21 is driven into a hole 15 as described. Here again, the desired size of the impact energy can be easily ascertained by making a test with differently adjusted positions of the knob 25, which, in accordance with its different axial position, provides the spring with different biased conditions. Incidentally, such spring mechanisms are, for instance, also known in connection with cigarette lighters having a piezo-electric ignition.

Although the invention has been described with reference to specific example embodiments, it will be appreciated, that it is intended to cover all modifications and equivalents within the scope of the appended claims.

What we claim is:

1. A system for securing a mounting member having a wedging socket in a hole of a structural component, comprising a fastener having a longitudinally divided shaft having first and second shaft sections which are slidable relative to each other in the longitudinal shaft direction, each of said shaft sections having a wedging portion (14, 14*a*) together forming said wedging socket, said shaft sections being initially axially displaced relative to each other by a defined distance (v) in a starting position, said wedging portions (14, 14*a*) being correspondingly axially displaced relative to each other by said defined distance (v) so that the wedging portion of said first shaft section is fully inserted in to said hole in said starting position while the wedging portion of said second shaft is only partially inserted into said hole in said starting position, said system further comprising power drive means for completely forcing said wedging portion of said second shaft section into said hole to wedge said wedging socket into said hole in a final wedged-in position, said power drive means comprising a housing having a grip, trigger means for releasing a drive stroke, and a holder recess means in said housing for holding said shaft sections in said starting position, power driven driving means operatively mounted in said housing in alignment with an axial bore in said holder recess means for driving said second shaft section with its wedging portion into said hole in which said wedging socket is held in said final wedged-in position, and power supply means responsive to said trigger means for applying said drive stroke to said second shaft section, whereby said first shaft section limits the movement of said second shaft section to said defined distance (v).

2. The system of claim 1, wherein said power supply means for applying said drive stroke comprise a source of pressurized air, and wherein said driving means comprise a piston cylinder device including a driver piston rod for performing said drive stroke.

3. The system of claim 2, further comprising valve means (11) provided in a conduit for pressurized air between said source of pressurized air and said driving means, said valve means being adjustable for adjusting an impacting energy of said driver piston rod.

4. The system of claim 1, wherein said power supply means for applying power comprise a cockable spring, and wherein said driving means comprise a driver arranged to be driven by said spring.

5. The system of claim 4, further comprising means (25) for adjusting the tension of said cockable spring.

6. The system of claim 1, wherein said holder recess means comprises a fixed hollow member secured to said housing for holding said first and second shaft sections, and a slidable member guided inside said hollow member for transmitting a driving force onto said second sharft section.

7. The system of claim 1, wherein said holder recess means comprises a single piece hollow member for receiving and guiding said shaft sections.

8. The system of claim 1, wherein said holder recess means has a stationary hollow guide member for receiving said shaft sections, and a movable member slidable inside said hollow member, said movable member having a facing surface for taking up an impact of said driving means and for transmitting said impact to said second shaft section.

9. The system of claim 1, wherein said first and second shaft sections together have an approximately square cross-section, and wherein said holder recess means enclose a recess also having an approximately square cross-section for receiving said first and second shaft sections in said recess prior to releasing said drive stroke.

* * * * *